US007762103B2

(12) United States Patent
Artsiely

(10) Patent No.: US 7,762,103 B2
(45) Date of Patent: Jul. 27, 2010

(54) ABSORPTION COOLING SYSTEM

(75) Inventor: Yehuda Artsiely, Hertzelia (IL)

(73) Assignee: Totec Ltd., Ramat Hasharon (IL)

( * ) Notice: Subject to any disclaimer, the term of this patent is extended or adjusted under 35 U.S.C. 154(b) by 85 days.

(21) Appl. No.: 11/770,062

(22) Filed: Jun. 28, 2007

(65) Prior Publication Data

US 2008/0016902 A1 Jan. 24, 2008

(51) Int. Cl.
*F25B 15/00* (2006.01)

(52) U.S. Cl. ..... 62/476; 62/478; 62/483

(58) Field of Classification Search ..... 62/476, 62/478, 481, 483, 497, 498
See application file for complete search history.

(56) References Cited

U.S. PATENT DOCUMENTS 4,428,854 A * 1/1984 Enjo et al. ..... 252/69
6,523,357 B1 2/2003 Katayama
6,536,229 B1 3/2003 Takabatake et al.
6,564,572 B1 5/2003 Uchimura et al.
6,748,762 B2 6/2004 Yamazaki et al.
6,845,631 B1 1/2005 Hallin et al.
7,582,224 B2 * 9/2009 Artsiely ..... 252/69

* cited by examiner

*Primary Examiner*—Melvin Jones
(74) *Attorney, Agent, or Firm*—Lucas & Mercanti, LLP

(57) ABSTRACT

The invention provides an absorption cooling system of the type including a liquid absorbent that remains in the liquid phase throughout the operation cycle, and a refrigerant having both a liquid phase and a vapor phase in the cycle, the basic system being powered by heat extracted from a hot fluid and powered auxiliary components, the system including the five basic components of a generator, an economizer, a condenser, an evaporator and an absorber, and further including a fluid circuit for the rich solution including a circulation pump, a fluid circuit for the lean solution, and for the refrigerant gas extracted from the liquid absorbent and replaced therein, partial circuits for hot fluid and for a cooling fluid, a jet mixer operating to mix saturated refrigerant gas with the lean solution to re-form the rich solution, the improvement comprising installing means for increasing the pressure of the saturated refrigerant gas flowing from the evaporator to the jet mixer.

10 Claims, 3 Drawing Sheets

Legend:

$Q_0$ - module capacity [T.R.]

Thw - Hot Water IN temp. [°C]

COP - Coeficient of performance:

Tcm - chilled media temp. [°C]

Tcw - cooling water temp. [°C]

$\frac{N}{Q_0}$ - elect. Consumption per T.R.

| Machine type | $Q_0$ T.R. | Tcm °C | Tcm °C | Thw °C | C O P | $\frac{Nm}{Q_0}$ |
|---|---|---|---|---|---|---|
| E-5 | 25 | 5 | 85 | 27 | 1.00 | 0.36 |
| E-5 | 25 | 0 | 90 | 27 | 0.77 | 0.40 |
| E-5 | 20 | -5 | 95 | 27 | 0.82 | 0.48 |
| E-5 | 20 | -10 | 105 | 27 | 0.58 | 0.50 |
| E-5 | 20 | -15 | 130 | 27 | 0.45 | 0.55 |
| E-5 | 15 | -20 | 125 | 27 | 0.45 | 0.70 |
| E-5 | 25 | 8 | 80 | 27 | 1.09 | 0.34 |
| E-4 | 20 | 5 | 110 | 27 | 0.58 | 0.20 |
| E-4 | 20 | 0 | 130 | 27 | 0.42 | 0.28 |
| E-5 | 30 | 7 | 95 | 28 | 0.91 | 0.32 |

FIG. 3

ABSORPTION COOLING SYSTEM

The present invention relates to an absorption cooling system.

More particularly, the invention provides an improved refrigeration system requiring the addition of a small gas compression device that raises the COP (Coefficient of Performance) of a prior art absorption cooler by over 40%.

Absorption refrigerating machines remove heat from the refrigerated load by means of an evaporator which transfers heat from the chilled medium to a refrigerant in vapor phase, whereafter a water-cooled absorber, later in the cycle, dissipates heat from said heated vapor. More specifically, a solution of absorbant and refrigerant are passed through a first heat exchanger, referred to as a generator, through which a hot fluid is passed. As a result part of the refrigerant passes to vapor phase and the resulting two-phase stream is directed to a separator which separates refrigerant gas extracted from said liquid absorbent and remaining liquid refrigerant, referred to as a lean solution. The refrigerant in vapor phase is then passed to an further heat exchanger, referred to as a condenser, which has a cooling fluid passing therethrough, whereby, through heat exchange, the vaporized refrigerant is recondensed to liquid form, and in this condition is passed through an expansion valve and changes its physical condition back to a vapor phase in a third heat exchanger, referred to as the evaporator. This phase change absorbs heat from the chilled media that flows through said evaporator in heat exchange but not physical contact therewith. The refrigerant, still in vapor phase, exists the evaporator and is sent to a jet mixer where it is physically combined with a lean solution from said separator and then sent to a fourth heat exchanger, referred to as an absorber, where the final absorption between the lean solution and the refrigerant which was previously in vapor phase is completed, aided by dissipation of heat via heat exchange through a cooling fluid passing therethrough. The evaporator is operated at a low pressure, while staying above atmospheric pressure at all times, while the condenser works at a high pressure, as in an electrically-driven compression cycle. However, in an absorption machine, the energy required by the evaporator is usually provided by waste heat from an engine or another electricity-generating device, or whatever heat source is cheaply available, while all the energy required by compression refrigerating machines is supplied by electric power or engine power.

Absorption type refrigerating machines are today mostly found in industrial plants where waste process heat, or unutilized flue gas, is readily available. Electric power generating stations produce vast quantities of waste heat which could be available at the cost of a gas to liquid heat exchanger by building an insulated pipeline and a non-insulated return line. Absorption refrigerating machines are also found in some mobile homes and recreational vehicles where engine exhaust gas, or water from engine cooling, is available at no cost and electric power is in limited supply. Most of the market, and particularly the residential sector, has been captured by compression-type refrigerating machines. These require no costly plumbing from the heat source to the cooling device, but consume much more electric power, and therefore require heavy cables and costly components.

Absorption-type cooling units, often in large sizes, are used industrially for providing chilled water, and where waste steam, hot water or a steady supply or a hot exhaust gas is readily available, prior art absorption machines already outperform compression types. In small installations it is usually not economic to install the piping needed for the absorption-type refrigerating machines in order to save small quantities of electric power. This situation would however change were there available an absorption-type machine with a greatly improved COP, or the cost of electric power rises sharply, which is presently (2005) a likely outcome due to oil prices reaching record highs of around $55 per barrel and higher.

Furthermore, it is possible to raise efficiency for the same cooling capacity and thus requiring a lower amount energy source resulting in the burning of less fossil fuel or the utilization of less electricity from a power station, which in turn also results in a reduction in the burning of fossil fuel, less pollution and especially less emission of $CO_2$ to the atmosphere, which reduction today, is encouraged with monetary incentives.

Thus a process involving a greatly improved COP means that there is a substantial increase in the efficiency of the process. Furthermore, when using solar energy as the energy source, then the system can utilize a smaller collecting area and such a system could be especially effective and economical in a context of solar powered air conditioning.

The state of the prior art can be assessed by a review of recent U.S. Patents.

In U.S. Pat. No. 6,523,357 B1 Katayama discloses an absorption refrigerating machines provided with the conventional components but wherein heat exchangers operate by spraying a cold liquid over the outside of piping conveying the hot liquid moving therethrough. The claimed improvement is in the generator arranged to directly introduce exhaust gas or hot water therein, the aim being to allow uninterrupted operation of an engine or turbine from which heat is recovered even when it becomes necessary to shut down the refrigerating machines in response to declining cooling demand.

Takabatake et al. disclose a steam type absorption refrigerating machines in U.S. Pat. No. 6,536,229. In addition to the conventional components the refrigerating machines includes a fluid concentrating boiler and separate heat exchangers for low and high temperature fluid. The aim is to improve the performance of a steam-type double-effect absorption refrigerating machines.

In U.S. Pat. No. 6,564,572 B1 Uchimura et al. propose a compact absorption refrigerating machines for central air conditioning systems intended primarily for installation in a cellar or on a rooftop where a high device would be impossible or objectionable. This is achieved by producing the absorber, the evaporator, the regenerator and the condenser all as liquid film type heat exchangers arranged in one horizontal plane.

The absorption refrigerating machines disclosed by Yamazaki et al. in U.S. Pat. No. 6,748,762 B2 is aimed at corrosion prevention caused by water vapor condensing out of the exhaust gas in a heat exchanger recovering heat from exhaust gas. A heat sensor monitors the temperature of the gas section of the heat exchanger. A controller calculates when it is necessary to direct a hot absorption liquid to warm the exhaust pipe to prevent the accumulation of water therein.

A vertically divided absorption refrigerating machines cabinet is seen in U.S. Pat. No. 6,845,631 to Hallin et al. The evaporator tube passes in series through both compartments, the colder compartment being upstream from the warmer (less-cold) compartment.

The present inventor has developed an absorption refrigerating machine which will be referred to as an E-4 machine, which is shown in FIG. 1 and marked prior art. The E-4 machine has been found to operate satisfactorily, although it cannot operate below 0° C. and has a COP of 0.58 at 5° C. and 0.6-0.7 at 7° C., which is the COP of the commercially used lithium bromide system and a COP of 0.42 at 0° C.

It is clear that if a refrigerating machine were to be developed that could operate at below zero temperature and had an improved COP and used a lower activating temperature, a much wider market would open for such a machine.

It is therefore one of the objects of the present invention to obviate the disadvantages of prior art cooling systems and to provide refrigerating machines which can operate at below zero C temperature.

It is a further objective of the present invention to substantially improve the COP of the machine.

Another objective of the invention is to reduce the size and initial cost of the refrigerating machines.

Yet a further object of the present invention is to achieve these objectives without substantial increase in electricity consumption.

The present invention achieves the above objectives by providing an absorption cooling system of the type including a liquid absorbent that remains in the liquid phase throughout the operation cycle, and a refrigerant having both a liquid phase and a vapor phase in said cycle, the basic system being powered by heat extracted from a hot fluid and powered auxiliary components, the system including the five basic components: i.e., a generator, an economizer, a condenser, an evaporator and an absorber, and further including a fluid circuit for the rich solution including a circulation pump, a fluid circuit for the lean solution, and for the refrigerant gas extracted from said liquid absorbent and replaced therein, partial circuits for hot fluid and for a cooling fluid, a jet mixer operating to mix saturated refrigerant gas with said lean solution to re-form said rich solution, the improvement comprising installing means for increasing the pressure of said saturated refrigerant gas flowing from said evaporator to said jet mixer.

The term economizer, as used herein, is intended to denote heat exchangers and similar devices.

In a preferred embodiment of the present invention there is provided an absorption cooling system wherein the combined electrical consumption of said rich solution circulation pump and said pressure increasing means of said saturated refrigerant gas is less than 1 kilowatt per ton of refrigeration, when operating above 0° C., and preferably less than 0.5 kw.

In a further preferred embodiment means for increasing the pressure of said saturated refrigerant gas is a screw, rotating or reciprocating compressor, or any other type of compression device.

Thus the present invention provides for the first time an absorption cooling system, that combines absorption and partial compression methods.

Thus in preferred embodiments of the present invention, there is provided an absorption cooling system as herein defined having a Coefficient of Performance (COP) which is at least about 40% higher than any other absorption refrigeration system not equipped with said pressure increasing means.

In a most preferred embodiment of the present invention there is provided an absorption cooling system usable below zero degrees Centigrade charged with a refrigerant and liquid absorbent having an Ozone Depletion Potential (ODP) below 0.02, and a Relative Global Warming Potential (GWP) below 0.2, as rated in comparison with the now prohibited refrigerant fluid R11 (trichlorofluoromethane) scoring 1.0 for both ODP and GWP, said absorption cooling system having a COP of at least about 40% greater than the prior art E-4 machine seen in FIG. 1, and even greater when compared to lithium bromide single stage systems.

In especially preferred embodiments of the present invention, there is provided an absorption cooling system as defined herein having a positive pressure on its low pressure side throughout the working and rest cycles, and even when the system is shut off.

It will thus be realized that the novel device of the present invention introduces the concept of increasing the velocity of the gas entering the lean liquid flowing through the jet mixer which in turn increases the velocity of the fluid passing through the various heat exchangers. The faster flow improves the heat transfer coefficient in the heat exchangers through which the refrigerant passes and thus allows the reduction of their size and cost.

There are however further advantages in increasing the flow and pressure of the newly-mixed rich solution leaving the jet pump, which item can now be made smaller. With the new pressure rise of the rich solution a lower pressure differential needs to be overcome by the circulation pump, which can now be made smaller and consumes less electric power. The power saved by the smaller circulation pump is almost equal to the power required by the newly added gas compressor. Consequently there is little change in the overall electric consumption of the E-5 refrigerating machines in comparison with the E-4 model.

Furthermore, there is a much lower consumption if compared to a compression type cooling wherein the typical electricity consumption for compression type cooling is 1.28 Kilowatts per ton of refrigeration, wherein the electricity consumption for the E-5 system is about 0.32 Kilowatts per ton of refrigeration (Kw/TR).

The most important results, which are taken from the Test Data provided in FIG. 3, are as follows:

a) the E-5 refrigerating machines described can operate at −20° C. which was not possible with the prior-art E-4 model, and therefore the present invention provides for a non-ammonia based absorption cooling system, which is therefore environmentally friendly, and which can provide chilled media temperatures as low as −20° C.; and b) at 5° C. the E-5 model operates with a COP of 1.00 compared to a COP of 0.58 of the E-4 at the same temperature. The COP for zero temperature is 0.77 for the E-5 and 0.42 for the E-4.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 3 is a Performance Test Data Sheet; of both the E-4 and the E-5 refrigerating machines.

Figure 1:
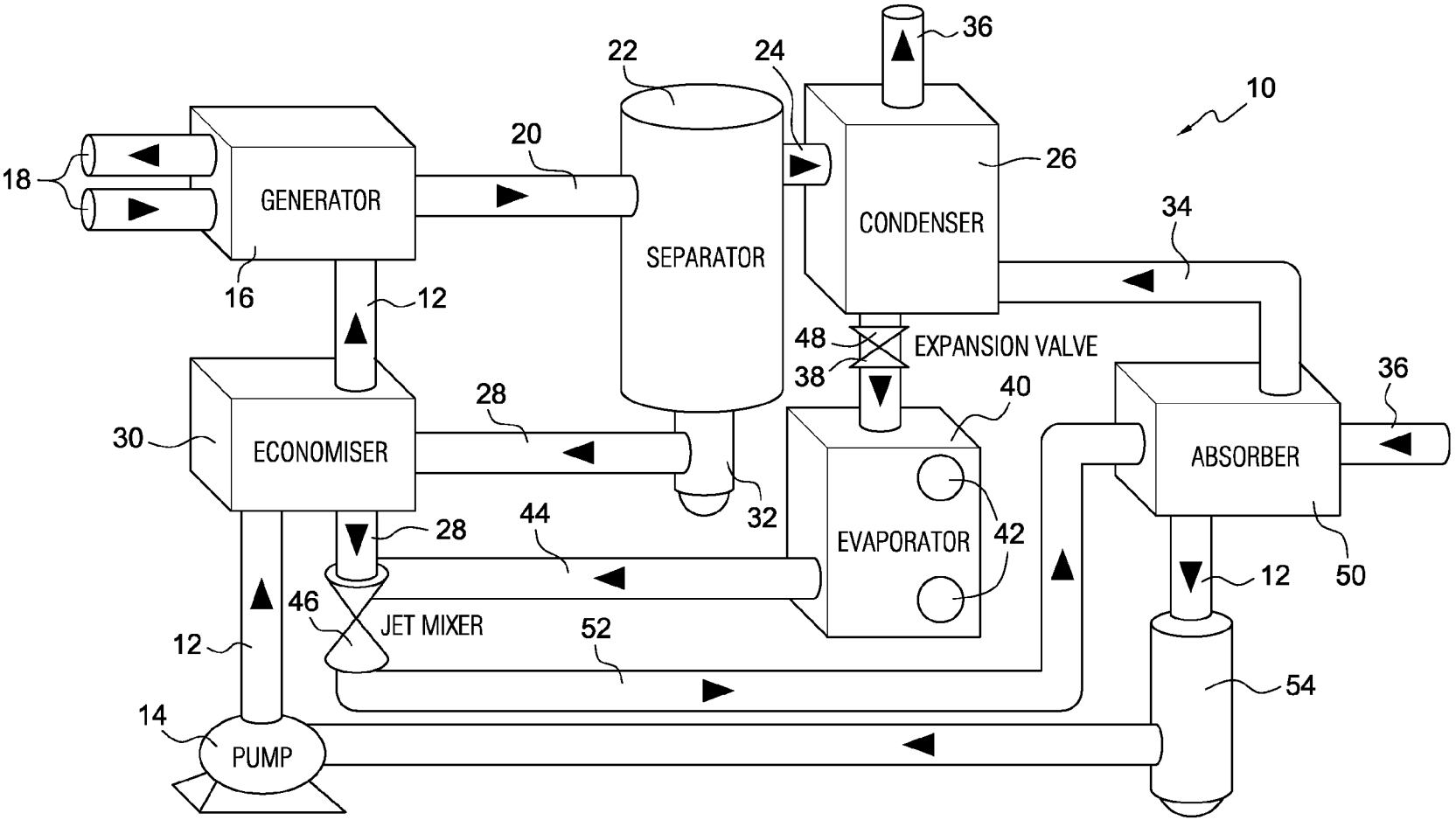
FIG. 1 Prior Art
FIG. 1 is a simplified schematic view of an E-4 prior art cooling system.

There is seen in FIG. 1 a prior art cooling system describing the E-4 machine 10. A vapor-saturated refrigerant 12 is driven in a circuit by a circulation pump 14 and is heated in a generator 16. The generator 16 is a heat exchanger through which hot fluid 18 (usually steam, flue gases or hot water) flows driven by external means. The heated rich solution 20 refrigerant starts to boil and enters a separator 22 wherefrom superheated vapor 24 goes to a high-pressure condenser 26. From the lower part 32 of the separator 22 a hot lean solution 28 resulting from loss of refrigerant enters an economizer 30, which is a heat exchanger which extracts heat from the lean solution 28. This heat is added to the rich solution 12 in the economizer 30. A condenser 26 is a high pressure heat exchanger cooled by a stream of cold water 34 driven in an external circuit 36. The condenser 26 cools the refrigerant vapor to reach its liquid phase and is then at about room temperature and under pressure. The refrigerant liquid 48 now passes through an expansion valve 38 and then enters an evaporator 40 which is a low-pressure heat exchanger. The load liquid circuit 42 is cooled in the evaporator 40 while the refrigerant is heated to form a saturated vapor 44. The refrigerant phase change from a liquid to a vapor requires the addition of heat. Which heat is extracted from the load 42 which is chilled, producing refrigeration. The saturated vapor 44 is then piped to a jet mixer 46 to be partially reabsorbed by the lean solution 28 to form a mixture 52. The re-absorption of the vapor 44 is completed in an absorber 50 which is also cooled by the cooling water 34 in circuit 36. From the absorber 50 the now reconstituted rich solution 12 is piped to a priming tank 54 and feeds the circulation pump 14.

Figure 2:
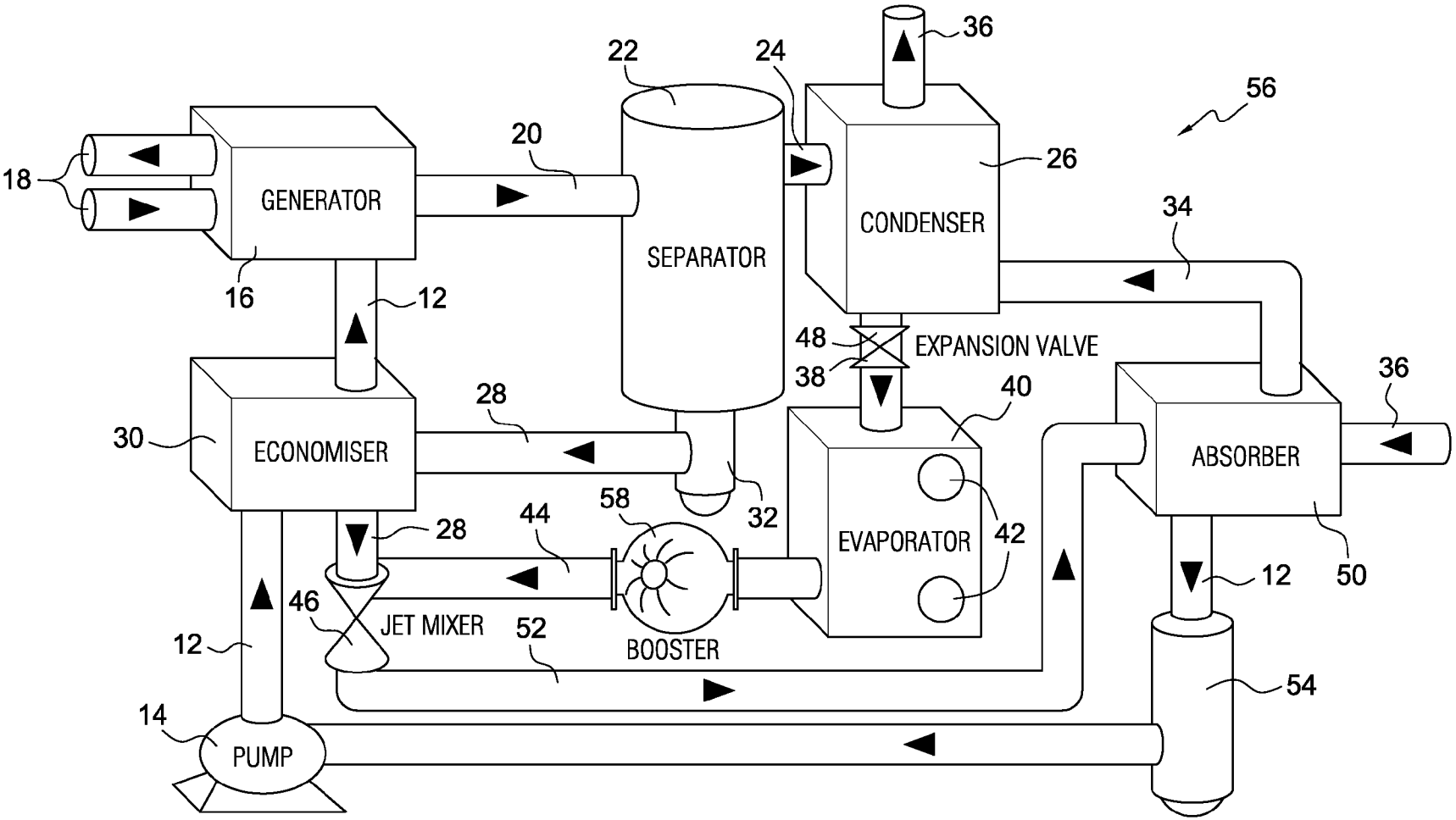
FIG. 2 is a simplified schematic view of a preferred embodiment of the cooling system, designated E-5, according to the present invention.

With regard to FIG. 2, similar reference numerals have been used to identify similar parts. The figure shows in simplified form an E-5 machine 56 according to the present invention.

An electrically-driven centrifugal gas compressor 58 is installed for increasing the pressure and flow of the saturated refrigerant vapor 44 flowing from the evaporator 40 to the jet mixer 46, although any suitable compressor can be used. In any case the flow and pressure of the vapor 44 is increased.

With regard to the increased flow rate, an improved heat-transfer co-efficient results as the fluid circulates faster in the various heat exchangers. This allows reducing the size of said heat exchangers, saving cost, volume and weight. The increased pressure resulting in the newly recombined refrigerant 52 also allows a reduction in the size of the circulation pump 14 with attendant savings in initial and running costs, by means of lower electricity consumption, because the pressure differential to be overcome by the pump 14 is reduced.

FIG. 3 is a Performance Test Data Sheet; relating to both the E-4 and the E-5 refrigerating machines, which were tested under similar conditions. Both refrigerating machines were charged with a new refrigerant, not damaging and in fact friendly to the environment.

It will be noticed that four tests, the $3^{rd}$ to the $6^{th}$ were carried out only on the E-5 machine, the reason being that the E-4 machine cannot be operated below zero. The E-5 machine was however run at temperatures as low as −20° C. in test no. 6 and produced a COP of 0.45, a marginal improvement over the E-4 machine running at the much higher temperature of zero degrees.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An absorption cooling system of the type including a liquid absorbent that remains in a liquid phase throughout an operation cycle, and a refrigerant having both a liquid phase and a vapor phase in said cycle, a basic system being powered by heat extracted from a hot fluid and powered auxiliary components, the system including five basic components of a generator, an economizer, a condenser, an evaporator and an absorber, and further including a fluid circuit for a rich solution including a circulation pump, a fluid circuit for a lean solution, and for a refrigerant gas extracted from said liquid absorbent and replaced therein, partial circuits for hot fluid and for cooling fluid, a jet mixer operating to mix saturated refrigerant gas with said lean solution to re-form said rich solution, the improvement comprising installing means for increasing pressure of a saturated refrigerant gas flowing from said evaporator to said jet mixer.

2. An absorption cooling system according to claim 1, wherein a combined electrical consumption of said rich solution circulation pump and said pressure increasing means of said saturated refrigerant gas is less than 1 kilowatt per ton of refrigeration, when operating above 0° C.

3. An absorption cooling system according to claim 1, wherein a combined electrical consumption of said rich solution circulation pump and said pressure increasing means of said saturated refrigerant gas is less than 0.5 kilowatt per ton of refrigeration, when operating above 0° C.

4. An absorption cooling system according to claim 1, wherein said means for increasing the pressure of said saturated refrigerant gas is a screw compressor.

5. An absorption cooling system according to claim 1, wherein said means for increasing the pressure of said saturated refrigerant gas is a reciprocating compressor.

6. An absorption cooling system according to claim 1, wherein said means for increasing the pressure of said saturated refrigerant gas is a rotary compressor.

7. An absorption cooling system according to claim 1, having a Coefficient of Performance (COP) which is at least about 40% higher than any other absorption refrigeration system not equipped with said pressure increasing means.

8. An absorption cooling system according to claim 1, charged with a refrigerant and liquid absorbent having an Ozone Depletion Potential (ODP) below 0.02, and a Relative Global Warming Potential (GWP) below 0.2, as rated in comparison with the now prohibited refrigerant fluid R11 (trichlorofluoromethane) scoring 1.0 for both ODP and GWP.

9. An absorption cooling system according to claim 1, wherein the system has working and rest cycles, and having a positive pressure cycle on its low pressure side throughout the working and rest cycles.

10. A non-ammonia based absorption cooling system according to claim 1 providing chilled media temperatures as low as −20° C.

* * * * *